United States Patent [19]

Chervenak

[11] 4,108,519

[45] Aug. 22, 1978

[54] PULL TRAY

[75] Inventor: Robert A. Chervenak, Seattle, Wash.

[73] Assignee: Comerco, Inc., Tacoma, Wash.

[21] Appl. No.: 791,315

[22] Filed: Apr. 27, 1977

[51] Int. Cl.[2] ..... A47B 95/02

[52] U.S. Cl. ..... 312/320; 312/350; 312/107; 312/229; 16/114 R

[58] Field of Search ..... 312/320, 107, 229, 350; 16/114 R, 122, 124, 100

[56] References Cited

U.S. PATENT DOCUMENTS

| | | | |
|---|---|---|---|
| 255,841 | 4/1882 | Croak et al. | 312/320 |
| 912,168 | 2/1909 | Reese | 312/229 |
| 2,758,748 | 8/1956 | Konefes | 312/320 |
| 3,107,389 | 10/1963 | Engelbrecht | 312/320 |
| 3,117,339 | 1/1964 | Vigna | 312/320 |
| 3,315,834 | 4/1967 | Nemlich | 312/320 |
| 3,338,649 | 8/1967 | Stewart | 312/320 |
| 3,580,439 | 5/1971 | Jewett | 312/107 |
| 3,752,547 | 8/1973 | Propst et al. | 312/108 |
| 3,826,550 | 7/1974 | Propst et al. | 312/350 |

FOREIGN PATENT DOCUMENTS

| | | | |
|---|---|---|---|
| 1,440,155 | 4/1966 | France | 312/107 |

*Primary Examiner*—Mervin Stein
*Assistant Examiner*—Victor N. Sakran
*Attorney, Agent, or Firm*—Gipple & Hale

[57] ABSTRACT

A pull tray is disclosed comprising a planar support surface for a plurality of articles. The pull tray is easily converted into a drawer with front handle by means of a removeable handle. The pull tray is provided with a pair of shoulders which are adapted to provide sliding surfaces for a pair of channels defined by the handle. Additionally, the pull tray is provided with a resilient retention means which serves to selectively allow the handle to be secured and removed from the pull tray.

15 Claims, 7 Drawing Figures

PULL TRAY

BACKGROUND OF THE INVENTION

This invention generally relates to drawers or trays such as used in organizing and storing a variety of smaller items. The drawers or trays can be removeably held within a storage cabinet which is provided with pairs of opposed, yet parallel, drawer glides. A storage cabinet or modular cell unit, specifically adapted for storing the drawers or trays is disclosed in my copending application Ser. No. 791,323. This specific modular cell unit is not, however, essential; other similarly adapted storage cabinets could function with the drawers or trays of this invention. The modular cell, drawers, or trays can be employed in a hospital setting, for example, to store a patient's personal belongings, clothing, or medicines. The present invention comprises a storage or supporting member which can easily be converted from a pull tray to a drawer with associated pull handle.

Any modern institutions, such as hospitals, hotels and schools, which must provide short term storage and related living facilities to members of the public face the problem of meeting a variety of different needs without maintaining a huge supply of different cabinets, dressers, etc. Such independent products and subsystems, in conflict with each other, are expensive to obtain and to store. Also, particularly in hospitals where sanitary procedures and controls are a major concern, it results in the practice of overcompensation to balance the unsanitizable character of many equipment structures. This group of "unsanitizable" structures include most furniture, professional equipment, transporting devices, containers and storage units of a larger size. All surfaces, without exception, should and need to be clearly accessible for removal of contaminated material and for sterilization. There should be no seams, no cracks, no interior grooves, no hinges and no unsealed shell interiors penetrable by air or liquid flow in order to preserve a sanitary atmosphere. With rare exception, present structures do not lend themselves to disassembly for proper cleaning.

In such institutions, it has increasingly become apparent that the visible physical characteristics of the room or surroundings can have a profound impact on the psychological outlook of the occupant. It is therefore beneficial to provide comfortable and uncluttered furnishings that still fulfill the sanitary requirements.

In order to be aesthetically pleasing to the occupant and yet maintain extreme functionality, a system of unitary modular cell units has been constructed. Each individual cell unit is capable of storing a variety of items of various shapes and sizes in an extremely aesthetically pleasing manner. The cell units or cabinets can be provided with a plurality of drawers or pull trays, as desired. These support devices are constructed of a hard, resilient, and durable plastic which can be submitted to heat and sanitarization without deterioration. The units are molded as one solid piece thereby eliminating unsightly seams. Additionally, the elimination of seams tends to substantially decrease the degree of impurities maintained in a structure after sterilization. The elimination of seams also tends to increase the component's structural strength. The pull trays or drawers are adapted to slide in and out of the front of a storage cabinet. These storage drawers or pull trays can be "mixed & matched" to provide a variety of cabinet configurations to meet the variety of needs. Quite obviously, the flexibility of a cabinet to take on a variety of functional embodiments is a tremendous advantage.

By allowing a pull tray to be easily converted into a drawer, the cabinet or modular cell which carries the trays or drawers can be provided with a variety of frontal closures, as desired. For example, if the pull trays are used in an ordinary cabinet containing drawer support guides, then a hinged door or tambour-type door could be used to seal the cabinet from potential contamination. Alternatively, the pull trays can be converted into drawers by means of a handle which snaps onto the front of the pull tray. If the drawers are used in a cabinet, then the handles serve the dual function of facilitating removal of the drawers from the cabinet in addition to eliminating the need for an independent frontal closure.

DESCRIPTION OF THE PRIOR ART

U.S. Pat. No. 3,752,547 discloses and claims a rectangular drawer with a guide flange extending from the rear and side walls for sliding and supporting the drawer.

U.S. Pat. No. 3,826,550 discloses a drawer and drawer supporting combination. The drawers are provided with glide flanges which glide over the guide flanges located along the interior walls of the drawer support cabinet.

SUMMARY OF THE INVENTION

The invention relates to a pull tray for use in a cabinet or modular cell unit which is easily converted into a drawer with handle. The pull tray comprises a planar base, four walls, and opposing glide flanges which are adapted to slide upon parallel pairs of internally extending flanges of a cabinet or modular cell unit. A variety of small articles can be held and supported upon the planar base of the tray.

In order to convert the pull trays to drawers, a hand plastic handle slides over the front of the pull tray and is held in place by a combination of a lower protruding lip and a pair of channelways located in the handle which slide over a pair of shoulders located on the front of the pull tray.

The ability of the pull tray to be able to be converted to a drawer and vice versa allows for greater versatility. For example, if desired the pull trays could be held within an ordinary storage cabinet. In order to close off the outside environment from possible contamination, a hinged door or drop front door could be utilized. Alternatively, however, the pull trays could be provided with the removeable handles. In this configuration, the handles serve a dual function. Not only do the handles facilitate the easy withdrawal of the drawers from the storage cabinets, but the handle, as it extends forward of the front wall of the pull tray, also acts as a frontal closure. This, then, eliminates the need for a separate and independent frontal closure. It should be appreciated that in a hospital environment, it is often crucial to prevent outside dust and other particle contamination from being in the immediate proximity to various items stored. It is contemplated that the pull trays and drawers of the present invention be utilized in a hospital environment and specifically within a modular cell unit as described in applicant's presently copending application.

The drawers or pull trays are also provided with drainage holes at selective points so that these elements can be placed within an industrial washer/sanitizer to clean and sanitize them while allowing the water to effectively drain off. Additionally, as mentioned, the pull trays are selectively provided with front handles which engage with and secure to the front of the pull trays to facilitate the withdrawal of the now-formed drawers from a modular storage cell unit. These front handles are readily disengaged from the trays and therefore are also easy to sanitize.

In many institutional uses, the front handles can be color coded so that the color of the handle can indicate the content or function of the drawer.

The above mentioned purposes are more readily apparent when read in conjunction with the following detailed description of the preferred embodiment of the present invention.

DETAILED DESCRIPTION OF THE DRAWINGS

Figure 1:
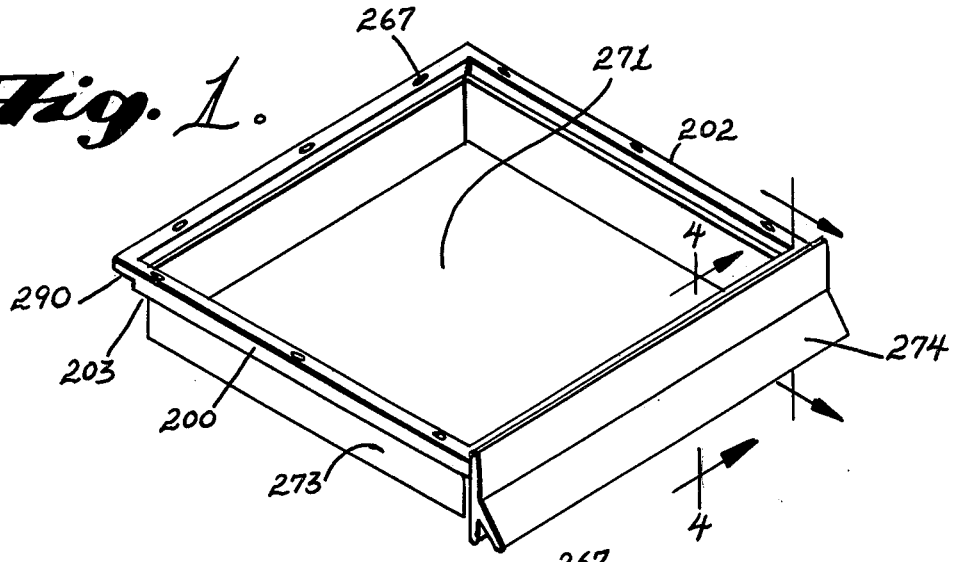
FIG. 1 is a perspective view of a drawer.
Figure 2:
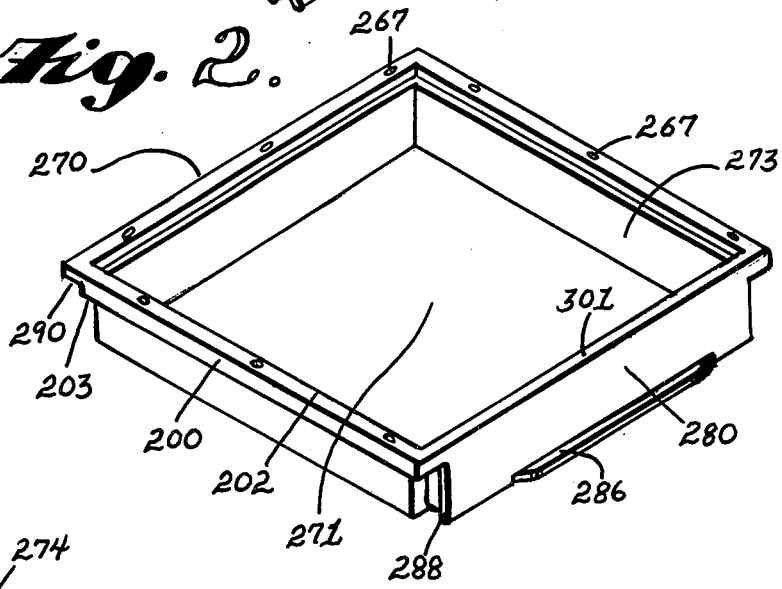
FIG. 2 is a perspective view of a pull tray.
Figure 3:
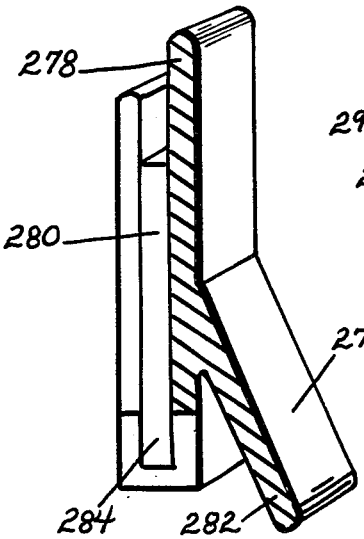
FIG. 3 is an enlarged rear elevational view of one side of the handle, with the opposite being a mirror image.
Figure 4:
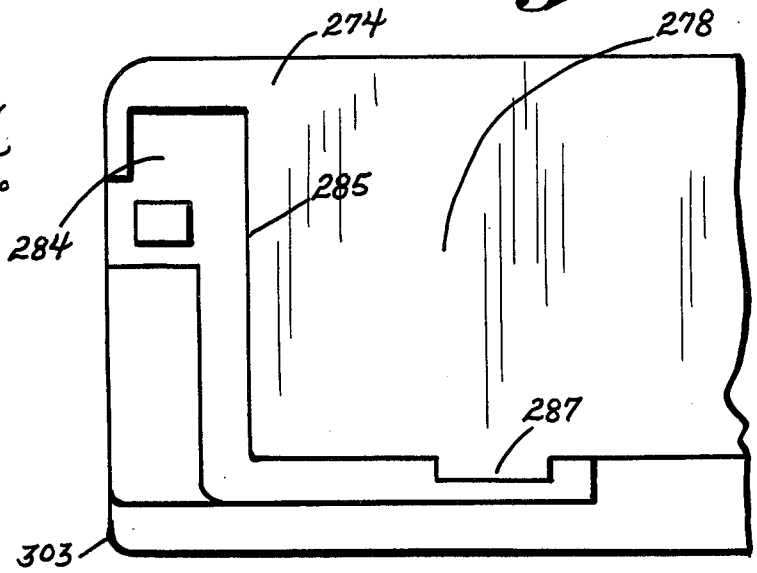
FIG. 4 is a cross sectional view taken along lines 4—4 of FIG. 1.
Figure 5:
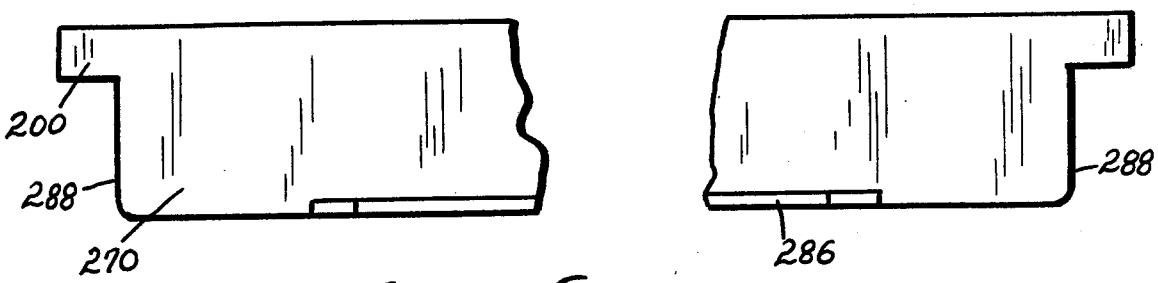
FIG. 5 is a front elevational view of the pull tray.
Figure 6:
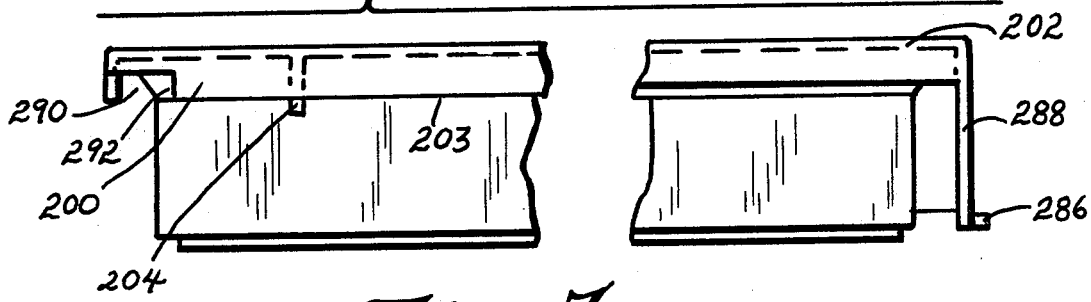
FIG. 6 is a side elevational view of the pull tray.
Figure 7:
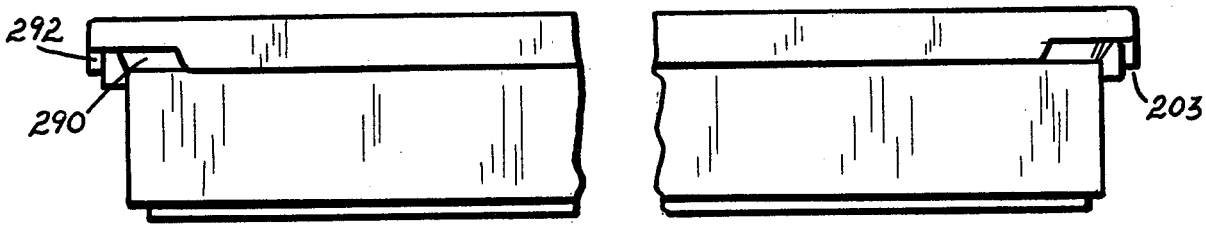
FIG. 7 is a rear elevational view of the pull tray.

As best seen in FIGS. 1 and 2, a pull tray 270 is provided with a flat base 271 and four walls 273. The flat base 271 provides support for a plurality of various articles. As the invention is specifically contemplated to be used in a hospital environment, drugs, eyeglasses, personal belongings, etc. could be stored within the drawers or pull tray. The walls are provided with horizontally extending flanges 202. Along the side walls of the drawer or pull tray are located a pair of parallel drawer gliders 200. The drawer gliders allow the drawer or pull tray to be supported by internally extending guide surfaces of a cabinet. The bottom surface 203 of the drawer gliders 200 serve to support the drawer or pull tray upon a cabinet's guide surfaces and also serve to facilitate the relative horizontal movement of the drawer or pull tray with respect to the cabinet.

The drawers and pull trays are provided with a plurality of drainage holes 267 which are located in the flanges 202 of the drawer or pull tray. The drainage holes 267 serve to allow water to easily drain off after sterilization and thereby prevent water retention in the system. The elimination of water retention, by providing a proper water drain-off system, prolongs the useful life of the system in addition to the elimination of potential germ propogation.

It should be noted that the drawers 272 are constructed by attaching the drawer handle 274 to the front of a pull tray 270. The handle comprises a rear flat piece 278 which is co-planar with the front 280 of the pull tray, when the handle is secured to the pull tray. A gripping surface 282 extends downwardly from the flat piece 278 of the handle and serves to provide a convenient grip for a user's hand in order to facilitate easy withdrawal of the drawer. On both sides of the rear surface of the handle 274 are guide means 284. The guide means 284 are spaced from the flat piece 278 and consequently a "U" shaped channel 285 is formed with the flat piece 278 forming one of the legs of the "U". The "U" shaped channels 285 slide over and matingly engage the horizontally extending shoulders 288 of the front 280 of the pull tray. The "U" shaped channels 285 are open on the top of the handle and closed towards the bottom of the handle. Grooves 287 are cut within the rear of the handle 274 and matingly engage and secure to the bottom of the front 280 of the pull tray. The front 280 of the pull tray is provided with a horizontally extending retainer lip 286. The front 280 of the pull tray is resilient with respect to the rest of the pull tray. The resiliency of the front 280 is a crucial aspect of the proper functioning of the device as will be explained hereinafter.

In operation, in order to convert a pull tray to a drawer, the handle 274 is directed such that the shoulders 288 of the front 280 of the pull tray pass within the "U" shaped channel 285 formed by the guide means 284 and flat piece 278. This is accomplished by sliding the open ends of the guide "U" shaped channels 285 upwardly over the shoulders 288 of the front. The rear planar surface of the handle will pass over the retainer lip 286, due to the latter's resiliency. Due to the fact that the guide means 284 are closed at their lower ends, the handle cannot continue to slide across the front of the door. Thus the handle is precluded from sliding above the top surface 301 of the pull tray by the closed guide means and the securing of the bottom of the front of the pull tray 280 within grooves 287. When the lower edge 303 of the handle passes over the retainer lip 286, the handle is effectively locked in place. The handle cannot slide off downwardly because the retainer lip prevents the handle's downward motion. The handle cannot slide upwardly off the front because the closed ends of the "U" shaped channels 285 and grooves 287 prevent such movement.

Thus it can be seen that the handle can securely attach to the front of a pull tray and convert the same into a drawer. The advantages provided by a pull tray which can be converted into a drawer by the simple attachment of a handle are apparent when the following is considered. The pull trays can be secured within an ordinary cabinet. The cabinet, in an attempt to be sealed from the outside environment, can be provided with a hinged front door or alternatively with a roll top closure. If the cabinet is not provided with any frontal closure then the handle 274 can be slipped onto and secured to the pull tray in order to convert the same into a drawer. The drawer, then, is provided with a convenient gripping handle. The handle, being of greater height than the height of the pull tray, effectively closes off the drawers from the outside environment when the drawers are stacked one upon another in a cabinet. In this manner, a cabinet closure could be eliminated without sacrificing the dust preventive mechanism or aesthetic appeal provided by a cabinet with frontal closure. Additionally, the handles can be color-coded for facilitating identification of drawers. The ability of the handles to be removed and then secured to the pull trays allows the trays' identification to be changed without movement of the modular cell unit or even the pull trays themselves.

When the drawer is to be reconverted to a pull tray, the user can merely push the retainer lip rearwardly while at the same time sliding the rear surface of the handle over the retainer lip in a downward direction. The resiliency of the retainer lip, therefore, is crucial to the proper addition and removal of the handle to the pull tray.

Corner cut-outs 290 are located at the rear corners of the flanges 202. The corner cut-outs 290 are provided with a vertical planar wall 292. The vertical planar wall 292 is adapted to abut against a stop member located at the rear of the guide surfaces of a cabinet. The abutment between the corner cut-outs and the internally protruding stop means prevents the pull tray or drawer from being pushed into the cabinet a greater distance than desired.

Located beneath the horizontally extending side flanges 202 are a pair of drawer stop elements 204. These drawer stop elements are adapted to abut against a second set of stop means located toward the front end of the guide surfaces of the cabinet. The abuttment of the front surface of the drawer stop elements 204 with the second set of stop means precludes the inadvertant total withdrawal of the pull tray.

While the preferred embodiment of the invention has been disclosed, it is understood that the invention is not limited to such an embodiment since it may be otherwise embodied in the scope of the appended claims.

What is claimed is:

1. A pull tray comprising a horizontal support means adapted to provide support to a plurality of articles, a pair of horizontally extending glide surface means adapted to support said support means within a cabinet and facilitate removal of said pull tray from said cabinet, a front vertically extending flat piece interconnected between said horizontally extending pair of glide surfaces, said front flat piece defining a pair of shoulders at the extreme edges of said front flat piece, a resilient retention means forwardly protruding from said plan flat surface, said shoulders and retention means being adapted to facilitate the selective securing and removal of handle means, said handle means having channel means adapted to slide over said shoulders and when secured to said flat front piece serving to convert said pull tray into a drawer with associated selectively removal handle means.

2. A pull tray as claimed in claim 1 wherein said glide surface means consist of downwardly extended vertical flanges, connected to said support means by horizontally extended flanges.

3. A pull tray as claimed in claim 2 wherein said horizontally extending flanges are provided with a plurality of drainage holes.

4. A pull tray as claimed in claim 1 wherein said handle means comprises a flat vertical portion, the back of said flat vertical portion being provided with a pair of guide means which guide means are spaced from said flat vertical portion a distance slightly greater than the thickness of said shoulders, said guide means and flat vertical portion defining a channel means adapted to slide over and matingly engage said shoulders and thereby secure said handle means to said pull tray.

5. A pull tray as claimed in claim 4 wherein said back of said flat vertical portion is provided with groove means which groove means are adapted to matingly fit beneath the front piece of said pull tray.

6. A pull tray as claimed in claim 1 wherein said retention means horizontally protrudes from said front piece a distance greater than the thickness of said handle means.

7. A pull tray as claimed in claim 4 wherein said handle means further comprises a downwardly inclined gripping means extending from said flat vertical portion adapted to facilitate movement of said pull tray.

8. A pull tray as claimed in claim 1 wherein said resilient retention means can be manually pushed rearwardly to remove said handle means from said drawer.

9. A pull tray as claimed in claim 1 wherein the rearward movement of said pull tray is limited by a pair of rear corner cut-outs which are adapted to abut against inwardly protruding stop means located within a cabinet to prevent inadvertant rearward movement.

10. A pull tray as claimed in claim 1 wherein said pair of glide surfaces are provided with a downwardly extending abutment stop means adapted to prevent the inadvertant total withdrawal of said pull tray from said cabinet.

11. A pull tray and handle means, said handle means adapted to selectively convert said pull tray into a drawer with said handle means being selectively secured thereto, said pull tray comprising a horizontal support surface means adapted to support a plurality of articles, a pair of parallel glide surface means adapted to slip upon and be supported by internal guide surfaces of a cabinet, a front piece extending between the forward portion of said support surface means and also extending vertically therefrom, said front piece being provided with a pair of opposed shoulder means at the ends of said front piece adapted to selectively matingly engage said handle means, said front piece being further provided with a resilient retention means adapted to preclude inadvertant removal of said handle from said pull tray, said handle means comprising a rear planar section, said section being provided with a pair of channel means adapted to slide over and matingly engage said shoulder means of said front piece, a plurality of groove means adapted to engage the bottom of said front piece when said handle means are secured to said front piece, said groove means being defined by said handle means, and a gripping means adapted to facilitate sliding of said drawer and said handle means as a unit.

12. A pull tray and handle means as claimed in claim 11 wherein said retention means comprises a resilient horizontally extending protrusion capable of being rearwardly pushed to allow said handle means to slide off of said pull tray's front piece.

13. A pull tray and handle means as claimed in claim 12 wherein said retention means extend from said front piece of greater distance than the thickness of said rear planar section of said handle means.

14. A pull tray and handle means as claimed in claim 11 wherein said glide surface means comprise downwardly extending vertical flanges, connected to said support means by horizontally extending flanges.

15. A pull tray and handle means as claimed in Claim 14 wherein said horizontally extending flanges are provided with a plurality of drainage holes.

* * * * *